US006029385A

United States Patent [19]

Howell, Jr.

[11] Patent Number: 6,029,385

[45] Date of Patent: Feb. 29, 2000

[54] CONVERSION CYLINDER AND METHOD FOR PERMITTING USE OF CARTRIDGE AMMUNITION IN CAP AND BALL REVOLVERS AND THE LIKE

[76] Inventor: Kenneth P Howell, Jr., 5728 E. County Rd. X, Beloit, Wis. 53511

[21] Appl. No.: 09/103,977

[22] Filed: Jun. 24, 1998

[51] Int. Cl.[7] ..... F41C 1/00

[52] U.S. Cl. ..... 42/59; 42/61

[58] Field of Search ..... 42/59, 61, 65

[56] References Cited

U.S. PATENT DOCUMENTS

| | | | |
|---|---|---|---|
| 12,555 | 3/1855 | Newbury | 42/61 |
| 35,404 | 5/1862 | Vaughan | 42/61 |
| 55,752 | 6/1866 | Wheeler | 42/59 |
| 142,175 | 8/1873 | Philip | 42/59 |
| 913,756 | 3/1909 | McCarty | 42/59 |
| 969,011 | 8/1910 | Vedder | 42/59 |
| 1,411,800 | 4/1922 | Molloy | 42/59 |
| 2,150,914 | 3/1939 | Gaidos | 42/59 |
| 2,238,587 | 4/1941 | Gaidos | 42/59 |
| 2,343,341 | 3/1944 | Sundquist | 42/59 |
| 3,050,894 | 8/1962 | Ivy | 42/59 |
| 3,757,448 | 9/1973 | Petrucci | 42/59 |
| 4,114,303 | 9/1978 | Vaughn | 42/59 |
| 4,253,261 | 3/1981 | Schmidt | 42/59 |
| 4,297,801 | 11/1981 | Kahn | 42/59 |
| 4,558,530 | 12/1985 | De Witt | 42/59 |
| 4,577,429 | 3/1986 | Waiser | 42/59 |
| 5,727,345 | 3/1998 | Sullivan | 42/59 |

*Primary Examiner*—Charles T. Jordan
*Assistant Examiner*—Denise J Buckley
*Attorney, Agent, or Firm*—Ryan & Kromholz & Manion

[57] ABSTRACT

A conversion cylinder assembly is provided for converting a 44 cal. cap and ball revolver to use with 45 Long Colt ammunition. To maintain authentic appearance and function, the conversion cylinder chambers up to six 45 Long Colt cartridges. To provide clearance for the cartridge rims, each of the chambers is angled slightly relative to the centerline of the cylinder and centerline of the barrel. This provides spacing for the ends of the cartridges while keeping the projectiles aligned with the barrel at the forward end of the cylinder.

8 Claims, 2 Drawing Sheets

CONVERSION CYLINDER AND METHOD FOR PERMITTING USE OF CARTRIDGE AMMUNITION IN CAP AND BALL REVOLVERS AND THE LIKE

BACKGROUND OF THE INVENTION

This invention relates generally to firearms and, more particularly, to methods and devices for converting older or obsolete firearms for use with cartridge ammunition.

Cartridge ammunition, wherein the propellant (powder), ignition device (primer) and projectile (bullet) are integrated into a single, easily handled cartridge, represented a major step forward in the development of firearms. Prior to that time, the powder and bullet or ball were loaded separately, as was a percussion cap used to ignite the powder. Loading was a tedious process that took considerable time. Additionally, the black powder in use at that time necessitated a rough cleaning before each loading and a thorough cleaning after each period of use. Accordingly, loading and cleaning a black powder firearm was a complicated, time-consuming affair. The advent of cartridge ammunition not only greatly simplified to loading process, but the later development of "smokeless" powders largely reduced the need for meticulous cleaning after each use. The development of cartridge ammunition, therefore, was a major advancement in firearms development.

Despite the advancement represented by cartridge ammunition, many original and replica firearms designed for non-cartridge operation remain in use today. Some enthusiasts enjoy the history and romance associated with firearms of the past, while others participate in historical recreations and the like that require the use of period firearms. Still others, who are engaged in the business of making movies, (e.g., "westerns") or producing plays, need firearms that are true to the time in appearance. For all these reasons, firearms that are clearly "obsolete" in terms of technical development remain firmly in use today well over a century after they were originally designed. Additionally, a thriving market exists for modern reproductions of these old designs as well.

Despite the popularity of old firearm designs, the original problems that led to the development of cartridge ammunition still remain. "Black powder" arms are still difficult and time consuming to load and still require thorough cleaning after use. Although having to deal with these difficulties is often what creates the appeal, there are definitely times when the disadvantages of black powder are a hindrance or nuisance and the benefits of cartridge ammunition are desired, even by those who relish the past.

Various attempts have been made to convert black powder firearms to use with cartridge ammunition. In the case of black powder "cap and ball" revolvers, these attempts have centered around replacing the original cylinder with one chambered for a compatible cartridge. In one approach, such as that shown and described in U.S. Pat. No. 3,757,448 to Petrucci, a conversion cylinder is provided that is arranged to accept center-fire cartridge ammunition. As disclosed in that patent, "The chamber arrangement in the cylinder . . . will have to be identical to the original cylinder." The approach taken by Petrucci is effective provided there is sufficient clearance in the conversion cylinder for the replacement cartridge ammunition. This is not always the case.

For example, as 44 cal. cap and ball revolvers and 45 Long Colt ammunition both share the same bullet or ball diameter, it is natural to seek to adapt a 44 cal. cap and ball revolver to use 45 Long Colt cartridge ammunition. When this is done using prior techniques, however, it is found that, because the cartridge dimensions of the 45 Long Colt exceed the chamber dimensions of the 44 cap and ball revolver, it is not possible to orient six 45 Long Colt cartridges in precisely the same position and spacing as the chambers in the 44 cap and ball revolver. In particular, the rim diameter of the 45 Long Colt is sufficiently great that the rims of six 45 Long Colt cartridges would interfere with each other if all six cartridges were oriented and spaced as in a 44 cap and ball revolver. Accordingly, the approach taken by Petrucci is ineffective in converting a 44 cal. cap and ball revolver to use with 45 Long Colt ammunition.

To solve this problem, past efforts have provided replacement cylinders that chamber only five 45 Long Colt cartridges rather than six. By eliminating one of the chambers, more room is available in the cylinder and the interference problem with the cartridge rims is avoided. However, the reduction in shot capacity is significant when historical accuracy is to be preserved and when the time-tested safety practice of keeping the hammer down on an empty chamber is followed, regardless of whether cartridge ammunition is being used.

In view of the foregoing, a need exists for an apparatus and method that enables modern cartridge ammunition to be used in firearms not originally designed for such use, without changing the appearance or essential operating characteristics of the firearm.

SUMMARY OF THE INVENTION

The invention provides a conversion cylinder assembly for adapting a cap and ball revolver to use with cartridge ammunition. The conversion cylinder assembly includes a cylinder having a central axis, a forward end, a rear end and a plurality of chambers disposed around the central axis with the ends of the chambers spaced closer to the central axis at the forward end of the cylinder than at the rear end of the cylinder so that each chamber slopes toward the central axis in the direction toward the forward end. The conversion cylinder assembly further includes a recoil plate adjacent the rear end of the cylinder and overlying the ends of the chambers at the rear end of the cylinder and a plurality of firing pins disposed on the recoil plate and individually associated with respective ones of the chambers.

The invention also provides a method of converting a firearm, not originally designed to use cartridge ammunition, to the use of cartridge ammunition comprising the step of positioning the cartridge so that the centerline of the cartridge is angularly displaced relative to the centerline of the firearm barrel while maintaining the cartridge projectile substantially aligned with the breach end of the barrel.

It is an object of the invention to provide a new and improved conversion cylinder that enables the use of modern cartridge ammunition in cap and ball revolvers and the like.

It is a further object of the invention to provide a new and improved method of incorporating cartridge ammunition into use with cap and ball revolvers and the like.

It is a further object of the invention to provide a conversion cylinder that enables a cap and ball revolver originally provided with a given number of chambers to chamber a like number of cartridges, even though the cartridges are of greater dimension than the original chambers.

It is a further object of the invention to provide new and improved conversion cylinder for permitting the use of cartridge ammunition in a cap and ball revolver wherein the appearance and operation of the revolver are substantially unchanged.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENT

Figure 1:
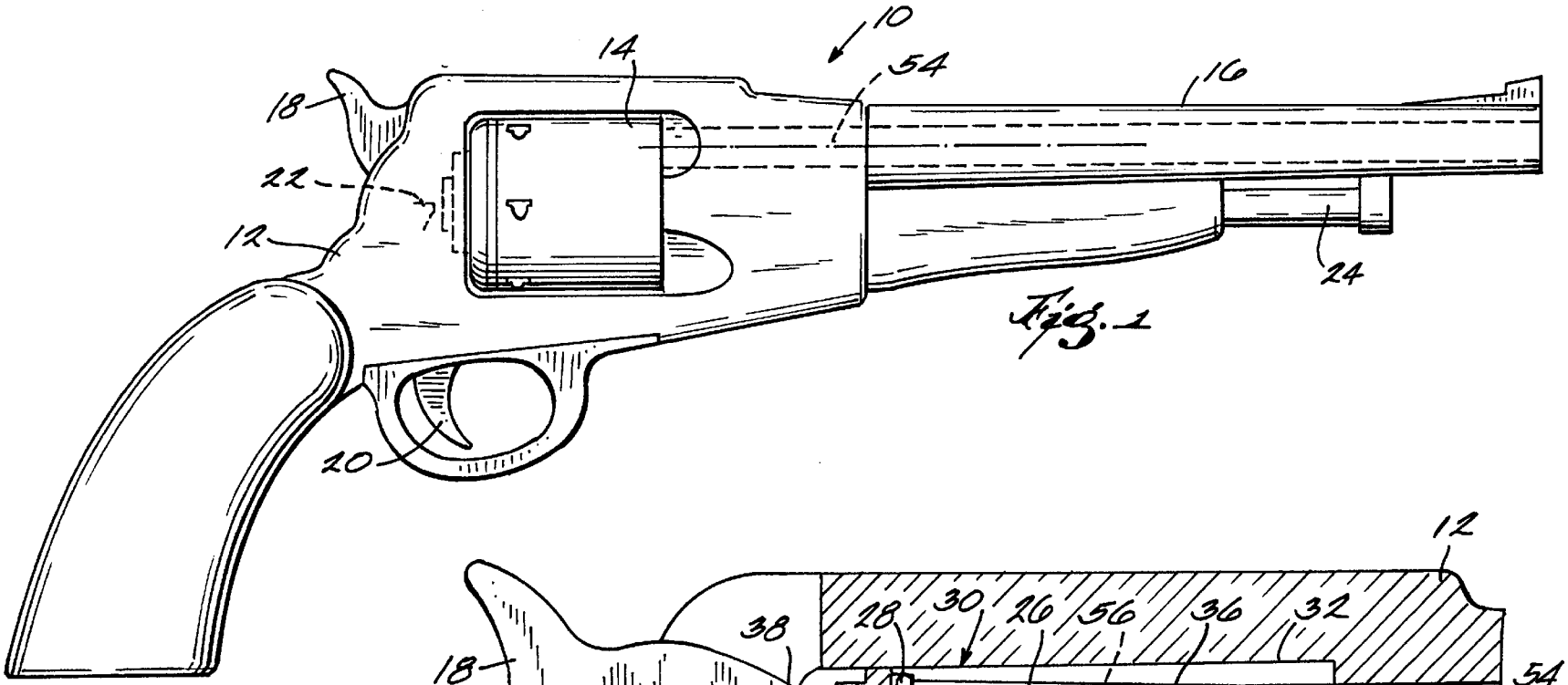
FIG. 1 is a side elevation view of a conventional cap and ball revolver suitable for being fitted with a conversion cylinder assembly embodying various aspects of the invention.

Referring to the drawings, and in particular to FIG. 1, a conventional cap and ball revolver 10 suitable for conversion to cartridge ammunition use is shown. In the illustrated embodiment, the cap and ball revolver 10 is a six shot, single action, 44 caliber cap and ball revolver. It will be appreciated, however, that the 44 cal. revolver is shown for illustrative rather than limiting purposes and that the invention, in its broader aspects, can be used with other calibers and styles of firearms beyond that shown here.

As illustrated, the revolver 10 includes a frame 12 that supports a rotatable cylinder 14, a barrel 16, a hammer 18 and a trigger 20. The cylinder 14 includes a plurality of individual chambers that are individually loaded with powder and ball and are individually rotated with the cylinder 14 into alignment with the barrel 16. A percussion cap is fitted to a nipple at the rear of each chamber and is struck by the hammer 18 when the trigger 20 is squeezed to fire each shot. When the hammer 18 is pulled back, a pawl 22 in the frame 12 engages and rotates the cylinder 14 to bring the next chamber into alignment with the barrel for the next shot.

In the illustrated embodiment, the revolver 10 includes six chambers thereby rendering it a "six shot" firearm. In actual practice however, most safety-conscious shooters carry the revolver 10 with the hammer 18 down on an unloaded chamber. This helps avoid accidental discharges in the event the revolver is dropped or the hammer is otherwise accidentally struck. Accordingly, although the revolver is nominally capable of delivering six shots before reloading, as a practical matter, the revolver 10 is generally considered a five shot arm.

Although capable of delivering five rapid shots, the process of loading and reloading a conventional cap and ball revolver is tedious and time consuming. After a measured charge of powder is poured into a chamber, a wad or other barrier is placed over the powder and a round lead ball is seated over the wad using the revolver's ram assembly 24. This process is repeated for each of the chambers to be loaded. Next, a layer of wax or grease is stuffed into the open ends of the loaded chambers to seal the chambers against possible sympathetic ignition when an adjacent chamber is fired. Finally, a percussion cap is placed onto the nipple of each loaded chamber. Because the process of loading is time consuming, it was once a common practice for shooters to carry additional, pre-loaded cylinders. Less time was taken in swapping a fresh cylinder for a spent one than was consumed in reloading the fired cylinder.

The advent of cartridge ammunition, wherein propellant, igniter, and projectile are all incorporated into a self contained, easily handled cartridge 26 (FIG. 2), greatly simplified the process of loading firearms, particularly repeating arms. In the case of the 44 caliber cap and ball revolver, it was natural for a cartridge to be developed around the 44 caliber projectile used in that arm. This cartridge became known as the 45 Long Colt. Both the 44 cal. cap and ball revolver and the 45 Long Colt cartridge shared a projectile measuring 0.452 inches in diameter, and a projectile discharged from a 45 Long Colt cartridge passes properly down the barrel of a 44 caliber cap and ball revolver.

Although the 44 cal. cap and ball revolver and the 45 Long Colt cartridge share the same projectile diameter, the cartridge dimensions of the 45 Long Colt differ substantially from the chamber dimensions of the 44 cap and ball revolver. For example, while the chamber diameter of the 44 cap and ball revolver is 0.452 inches, the cartridge diameter of the 45 Long Colt is 0.480 inches. Accordingly, a conversion cylinder for converting a 44 cal. cap and ball revolver for use with 45 Long Colt cartridges must include chambers large enough to accommodate the larger diameter of the 45 Long Colt cartridge case. More significantly, the 45 Long Colt cartridge case includes a rim 28 at one end that measures nominally 0.512 inches in diameter.

In a standard 44 cap and ball revolver cylinder 14, the spacing between the center line of each chamber and the center of the cylinder 14 is 0.490 inches. Although this provides adequate spacing for six chambers when the chambers each measure 0.452 inches in diameter, such spacing provides inadequate clearance for six 45 Long Colt cartridges. If six 45 Long Colt cartridges where oriented and spaced as in a standard 44 cal. cap and ball revolver cylinder, the rims 28 of the cartridge cases 26 would overlap and interfere with each other. Accordingly, and particularly in the case of a 44 cal. cap and ball revolver, a conversion cylinder, for converting the revolver to use with 45 Long Colt ammunition, cannot be obtained simply by enlarging the chambers of a standard cap and ball cylinder to accept the 45 Long Colt cartridges. The resulting overlapping and interfering rims of the 45 Long Colt ammunition prevent this simple expedient.

To provide a conversion cylinder for the 44 cal. cap and ball revolver, the approach in the past has been to provide a conversion cylinder having five rather than six chambers. By using only five 45 Long Colt cartridges, the external size of the conversion cylinder can match that of the original cap and ball cylinder, and the reduced number of chambers permits adequate spacing for the cartridge rims. Although effective in permitting the use of 45 Long Colt center-fire ammunition, such a conversion cylinder compromises authenticity in that only five, rather than six shots are possible, and only four rather than five shots were available if the safety practice of keeping the hammer down on an empty chamber was followed.

The apparatus and method of the present invention provides a conversion cylinder assembly 30 that permits the use of 45 Long Colt center-fire ammunition in a 44 cal. cap and ball revolver without changing the basic six-shot character of the firearm. The conversion cylinder assembly 30 of the present invention contains six, rather than five, chambers, each of which is capable of accepting a standard 45 Long Colt cartridge 26. The external dimensions and appearance of the conversion cylinder assembly 30 closely match those of the original cap and ball cylinder 14, and the actual shooting operation of the firearm closely resembles that of the original.

Referring to FIGS. 2–5, the conversion cylinder assembly 30 includes a cylinder 32 and a recoil plate 34 mounted to the rear end of the cylinder 32. The cylinder 32 includes six chambers 36, each shaped and dimensioned to receive or chamber a 45 Long Colt cartridge 26. The recoil plate 34 is positioned behind the cylinder 32 and includes six firing pins 38, one for each of the chambers 36. An indexing pin 40 extending from the rear surface of the cylinder 32 is received in an appropriately located, complementary hole 42 in the recoil plate 34 to fix the rotational position of the recoil plate 34 relative to the cylinder 32. As illustrated, the indexing pin 40 and hole 42 are positioned so that the firing pins 38 are located over the ends of the respective chambers 36 when the recoil plate 34 is properly positioned relative to the cylinder 32.

As further illustrated, the recoil plate 34 includes a central hub 44 that fits snugly into a complementary recess 46 formed around the central axis 48 of the cylinder 32 in the rear surface thereof. A central aperture 50 extending through the cylinder 32, the hub 44 and the remainder of the recoil plate 34 allows the conversion cylinder assembly 30 to be mounted into the revolver 10 in the same manner as the original cylinder 14. A plurality of ratchet teeth 52 formed in the rear surface of the recoil plate 34 are engaged by the pawl 22 in the revolver 10 to rotate the cylinder 32 to bring the next chamber 36 into alignment with the barrel 16 each time the hammer 18 is pulled back to the cocked position.

Figure 2:
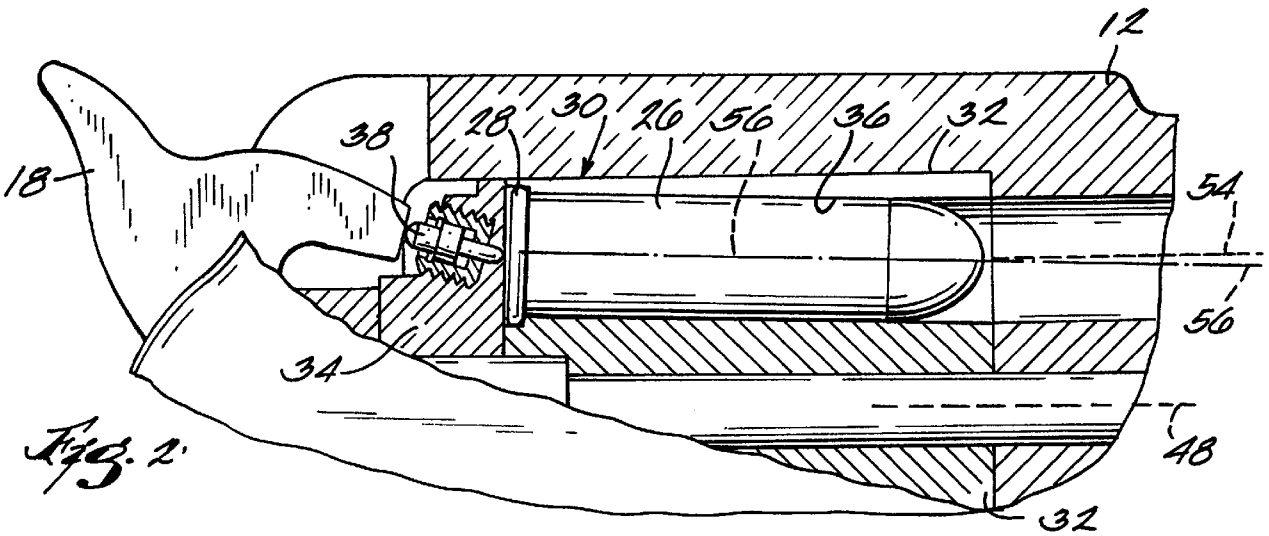
FIG. 2 is a fragmentary side view, partially in section, of the revolver shown in FIG. 1 after being fitted with a conversion cylinder assembly in accordance with various aspects of the invention and showing a chambered center-fire cartridge and the mechanism for firing the cartridge.
Figure 3:
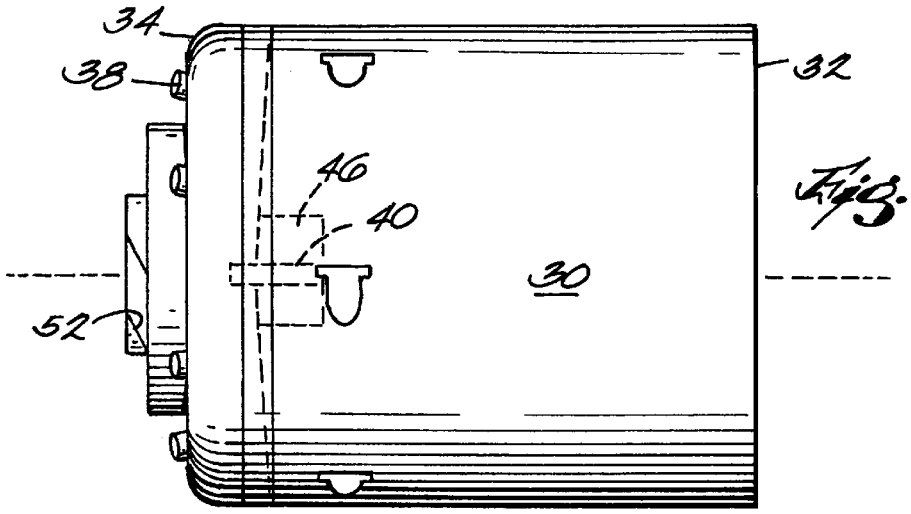
FIG. 3 is a side elevation view of the conversion cylinder assembly shown in FIG. 2.
Figure 5:
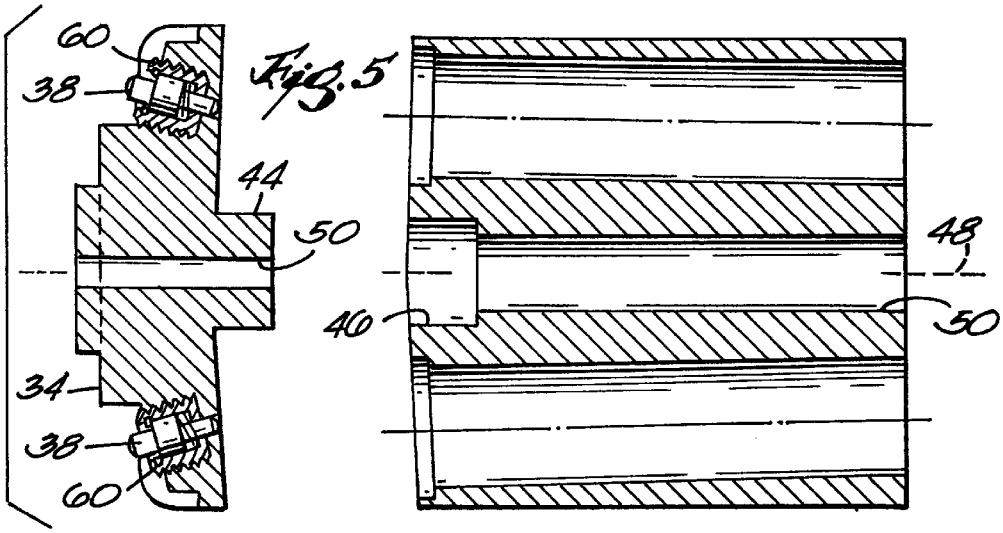
FIG. 5 is a cross-sectional view of the conversion cylinder assembly shown in FIGS. 4, taken along line 5—5 thereof.
Figure 4:
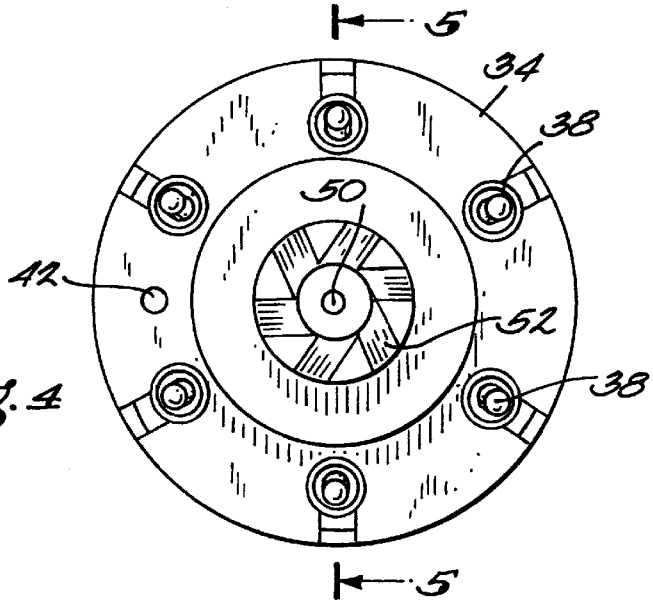
FIG. 4 is a rear view of the conversion cylinder assembly shown in FIGS. 2 and 3.

To provide adequate clearance for the rims 28 of the 45 Long Colt cartridges 26 while keeping the forward ends of the chambers 36 in alignment with the barrel 16, each of the chambers 36, in accordance with one aspect of the invention, is angularly displaced relative to the central axis or center line 54 of the barrel 16. As best seen in FIGS. 2 and 5, the center line 56 of each chamber 36 is not parallel to the central axis 48 of the cylinder 32 but, rather, slopes toward the cylinder central axis 48 in the direction toward the front of the cylinder 32. By sloping the chambers 36 in this manner, the rear ends of the chambers 36 are spread apart from each other while the forward ends of the chambers 36 retain the same spacing and orientation as the chambers of the original cap and ball cylinder 14. This geometry provides sufficient clearance for the rims 28 of the 45 Long Colt cartridges 26 at the rear of the cylinder 32 while maintaining proper registry of the chambers 36 with the barrel 16 at the forward end of the cylinder 32. In this manner, it is possible to provide six chambers 36*n* the conversion cylinder assembly 30 while maintaining the same external shape and size as the original cap and ball cylinder 14. Because of the interference problem caused by the rims 28 of the 45 Long Colt cartridges 26, this would not be possible if the center lines 56 of the chambers 36 were kept precisely parallel to the centerlines 48 and 54 of the cylinder 32 and the barrel 16.

For purposes of illustration, in a 44 cal. cap and ball revolver 10, the distance between the centerline of the cylinder 32 and the centerline of each chamber 36 in the cylinder 14 is 0.490 inches. As previously noted, such a cylinder spacing would provide inadequate clearance for the rims 28 of six 45 Long Colt cartridges 26. Accordingly, in the illustrated embodiment, the chambers 36 of the conversion cylinder assembly 30 are sloped so that the centerline 56 of each chamber 36 is spaced from the centerline 48 of the cylinder 32 by a distance of 0.516 inches at the rear of the cylinder 32 while maintaining the original 0.490 inch spacing at the front of the cylinder 32. Such angular offset provides sufficient clearance for the cartridge rims 28 while keeping the forward end of each chamber 36 in proper alignment with the forcing cone of the barrel 16.

Preferably, the firing pins 38 are dimensioned and located to match the size and position of the nipples of the original cap and ball cylinder 14. This enables the hammer 18 of the revolver 10 to strike each firing pin 38 without further modification or adjustment. As best seen in FIG. 5, each firing pin 38 extends through a hole in the recoil plate 34 and is confined therein by means of a threaded collar 60. The collars 60 keep each firing pin 38 in place with the recoil plate 34 while permitting the lateral movement necessary to fire the cartridge 26 when struck by the hammer 18.

Because the cartridges 26 are angularly oriented when chambered in the cylinder 32, the rear face of the cylinder 32 is not flat and perpendicular relative to the cylinder centerline 48 but, rather, is slightly cone-shaped to match the orientation of the cartridge ends. Similarly, the complementary face of the recoil plate 34 is similarly shaped to match the end of the cylinder 32. Accordingly, when the recoil plate 34 is properly positioned over the cylinder 32, each cartridge 26 is fully and closely encased by the conversion cylinder assembly 30.

To load the conversion cylinder assembly 30, the recoil plate 34 is first removed and the desired number of cartridges 26 are inserted into the chambers 36. The recoil plate 34 is then replaced, ensuring that the indexing pin 40 is properly received in the hole 42. Next, the entire conversion cylinder assembly 30 is mounted in the revolver for use. After firing, the conversion cylinder assembly 30 is removed and the recoil plate 34 separated from the cylinder 32 to permit the fired cartridge cases to be removed and fresh ammunition loaded.

It has been found that the angular misalignment of the cartridges 26 from the centerline of the barrel 16 has no effect on the operation or accuracy of the firearm. In all cases, the projectile is located adjacent the rear of the barrel 16 in proper alignment therewith, and it is only the remainder of the cartridge and the propelling gasses behind the projectile that are misaligned with the barrel 16. In practice, this has been found to have no effect on chamber pressures, accuracy or other aspects of the operation of the firearm.

It will be appreciated that, although the invention has been shown and described in connection with converting a six shot, single-action, 44 cal. cap and ball revolver to use with 45 Long Colt center-fire ammunition, the invention is not limited to this particular conversion or style of firearm. The invention is useful in other conversions wherein adequate clearance is not available for the cartridges when the cartridges are precisely aligned with the barrel over the entire cartridge length. Furthermore, the invention is useful in angularly displacing a cartridge relative to the hammer/firing pin to permit the use of rim-fire cartridges in place of certain cap and ball loads. By angularly displacing the cartridge, the rim of the cartridge can be made to fall under the firing pin while keeping the front of the cartridge in alignment with the barrel. It will be appreciated, therefore, that, although the invention is particularly useful in converting 44 cal. cap and ball revolvers to use with 45 Long Colt ammunition, the invention, in its broader aspects, is not limited to this particular conversion.

While a particular embodiment of the invention has been shown and described, it will be obvious to those skilled in the art that changes and modifications can be made without departing from the invention in its broader aspects, and, therefore, the aim in the appended claims is to cover all such changes and modifications as fall within the true spirit and scope of the invention.

I claim:

1. A conversion cylinder assembly for adapting a cap and ball revolver to use with cartridge ammunition, comprising:

a cylinder having a central axis, a forward end, a rear end and a plurality of chambers disposed around the central axis with the ends of the chambers spaced closer to the central axis at the forward end of the cylinder than at the rear end of the cylinder so that each chamber slopes toward the central axis in the direction toward the forward end;

a recoil plate adjacent the rear end of the cylinder and overlying the ends of the chambers at the rear end of the cylinder; and a plurality of firing pins disposed on the recoil plate and individually associated with respective ones of the chambers.

2. A conversion cylinder assembly as defined in claim 1 further including structure for indexing the recoil plate relative to the cylinder so that each of the firing pins is disposed over the end of an adjacent chamber.

3. A conversion cylinder assembly as defined in claim 1 wherein the number of chambers included in the cylinder is the same as the number of chambers originally included in the cap and ball revolver.

4. A conversion cylinder assembly as defined in claim 3 wherein the ends of the chambers at the rear end of the cylinder are spaced sufficiently far from the central axis as to provide clearance for the ends of the cartridges relative to each other.

5. A conversion cylinder assembly as defined in claim 4 wherein the external shape and dimensions of the conversion cylinder assembly substantially match the shape and dimensions of the cap and ball cylinder of the cap and ball revolver.

6. A conversion cylinder assembly as defined in claim 1 wherein the chambers are shaped and dimensioned to chamber 45 Long Colt ammunition.

7. A conversion cylinder assembly as defined in claim 6 wherein the cylinder contains six of the chambers.

8. A method of converting a firearm, not originally designed to use cartridge ammunition, to the use of cartridge ammunition comprising the step of positioning the cartridge so that the centerline of the cartridge is angularly displaced relative to the centerline of the firearm barrel while maintaining the cartridge projectile substantially aligned with the breech end of the barrel.

* * * * *